US008061067B2

(12) United States Patent
Pan et al.

(10) Patent No.: US 8,061,067 B2
(45) Date of Patent: Nov. 22, 2011

(54) IRON HOLDER

(75) Inventors: Chienchih Pan, Tainan (TW); Zhenxing Zheng, Fujian (CN)

(73) Assignee: Tsann Kuen (China) Enterprise Co., Ltd., Xiamen, Fujian (CN)

( * ) Notice: Subject to any disclaimer, the term of this patent is extended or adjusted under 35 U.S.C. 154(b) by 358 days.

(21) Appl. No.: 12/330,327

(22) Filed: Dec. 8, 2008

(65) Prior Publication Data

US 2010/0115806 A1 May 13, 2010

(30) Foreign Application Priority Data

Dec. 6, 2007 (CN) ..... 2007 1 0009970

(51) Int. Cl.
*D06F 79/02* (2006.01)
*D06F 79/00* (2006.01)

(52) U.S. Cl. ..... 38/96; 219/259; 248/117.2

(58) Field of Classification Search ..... 38/79, 96, 38/107; 219/246, 259; 248/447, 444.1, 469, 248/117.1, 117.4, 117.2; D32/73
See application file for complete search history.

(56) References Cited

U.S. PATENT DOCUMENTS 1,401,458 A * 12/1921 Boon ..... 248/456
1,468,296 A * 9/1923 Hodgson ..... 219/259
2,485,299 A * 10/1949 Levey ..... 219/259
2,982,506 A * 5/1961 Allen ..... 248/117.2
3,176,947 A * 4/1965 Inverso ..... 248/117.6
3,202,389 A * 8/1965 Zoffer ..... 248/117.4
3,408,032 A * 10/1968 Francis ..... 248/450
5,315,773 A * 5/1994 Iwami et al. ..... 38/77.6

* cited by examiner

*Primary Examiner* — Ismael Izaguirre
(74) *Attorney, Agent, or Firm* — Kening Li; Pinsent Masons LLP

(57) ABSTRACT

An iron holder comprises a base and an insulation board for supporting the iron, the base forming a revolvable relationship with the insulation board, and there is an angle adjusting unit is arranged between the insulation board and the base for adjusting the revolving angle of the insulation board revolving relative to the base. Because the insulation board and the base forms a pivoted relationship, and the angle adjusting unit can adjust the angle between the insulation board and the base, the insulation board can be adjusted into a preferred angle for the users to lay the iron; and the iron holder can be conveniently packed to reduce packing materials.

7 Claims, 9 Drawing Sheets

IRON HOLDER

FIELD OF THE INVENTION

The present invention relates to an iron holder, more particularly to an iron holder with an insulation board.

BACKGROUND OF THE INVENTION

An iron holder typically includes a base and an insulation board for supporting the iron and insulating heat. The insulation board of a traditional iron holder is fixed on the base in a special angle and position, and can not be moved or revolved. An iron, after being used, it cannot be conveniently to place the iron on the insulation board.

SUMMARY OF THE INVENTION

The primary object of the present is to provide an iron holder to obviate the disadvantages of the traditional irons that the insulation board is fixed on the base and can not be moved or revolved.

This and other objects of the present invention are achieved by providing:

an iron holder which comprises a base and an insulation board for supporting the iron, the base forming a revolvable relationship with the insulation board, and an angle adjusting unit arranged between the insulation board and the base for adjusting the revolving angle of the insulation board revolving relative to the base.

In one preferred embodiment of the present invention, the insulation board pivotally connected with the base, the angle adjusting unit comprising:

a sliding device formed sliding-connection relationship with the insulation board; and a step stool fixed on the base, and the step stool has at least a step, the said sliding device abuts against one step of the step stool.

In one preferred embodiment of the present invention, the side of the insulation board has a sliding track, the sliding device slidingly connected with the sliding track.

In one preferred embodiment of the present invention, there is a lock unit arranged between the sliding track and the sliding device for locking or releasing the sliding device relative to the sliding track.

In one preferred embodiment of the present invention, the lower portion of the sliding device has an abutting portion extending below the insulation board, the abutting portion abuts against one step of the step stool.

In one preferred embodiment of the present invention, the step stool has four steps.

In one preferred embodiment of the present invention, there are two lugs arranged on the lower portion of the insulation board, each lug has a revolving seat, the base has a coupler, the revolving seat pivotally connected with the coupler; the angle adjusting unit comprising:

an adjusting board fixed on the base, and the adjusting board has at least a lock hole, the at least a lock hole formed an arc whose center is on the shaft between the insulation board and the base; and a compress portion comprising a sleeve fixed on the lug, an elastomer in the sleeve and a ball abuts against the inner end of the elastomer, the inner terminal of the ball positioned in the at least a lock hole, and the diameter of the ball is larger than the diameter of the lock hole.

In one preferred embodiment of the present invention, the compress portion further comprises an adjusting screw which threads through the lug from the outside into the inner side, and the inner end of the screw connects with the out end of the elastomer.

In one preferred embodiment of the present invention, the adjusting board has six lock holes.

In one preferred embodiment of the present invention, the base has a groove for containing the insulation board when the insulation board is in the lowest position.

In one preferred embodiment of the present invention, the adjusting unit comprising:

a connecting penetration hole having at least a transverse recess portion in the inner side;

a push button, its end being through the penetration hole from the out side into inner side;

an elastomer connecting with the inner side of the push button, it sheaths the push button; and a block with a transverse protrusion, the head of the block connects to the end of the push button; normally the transverse protrusion of the block inserted in the transverse recess portion of the penetration hole by the action of the elastomer; if the push button is pressed, the push button will push the block back transversely, then the transverse protrusion of the push button disengaged from the transverse recess portion of the penetration portion.

In one preferred embodiment of the present invention, the base pivotally connected with the insulation board via a sleeve axis, the angle adjusting unit comprising at least:

a slider connecting slidingly with the sleeve on the shaft direction, and the side of the slider has a position protrusion;

a slot arranged in the base corresponding to the position protrusion and the position protrusion can slide along the axis direction of the slot;

an arc limit groove arranged on the insulation board corresponding to the position protrusion and the position protrusion can rotate limitedly in the groove;

a position opening in the sleeve corresponding to the slot; and a button on the insulation board for pushing the slider from the position between the insulation board and the base to the pivotal connection portion of the base.

Because the insulation board and the base formed pivoted relationship, and the angle adjusting unit can adjust the angle between the insulation board and the base, the present invention obviated the disadvantages in the existed arts and has the advantages as follows: firstly, the insulation board can be adjusted into a preferred angle for the users to lay the iron, so the holder has more convenient operation ability; secondly, it improves the appearance of the product; thirdly, it can be conveniently stored up in packing to reduce the packing materials. The insulation board can be revolved freely from 0 degree to 90 degrees, the screw can adjust the elasticity of the elastomer and adjust the force for revolving the insulation board, thus can meet the different demands of different users.

BRIEF DESCRIPTION OF THE DRAWINGS

Exemplary embodiments of the invention will be explained in more detail below with reference to the drawings, in which.

DETAILED DESCRIPTION OF THE PREFERRED EMBODIMENT

Embodiment 1

Figure 1:
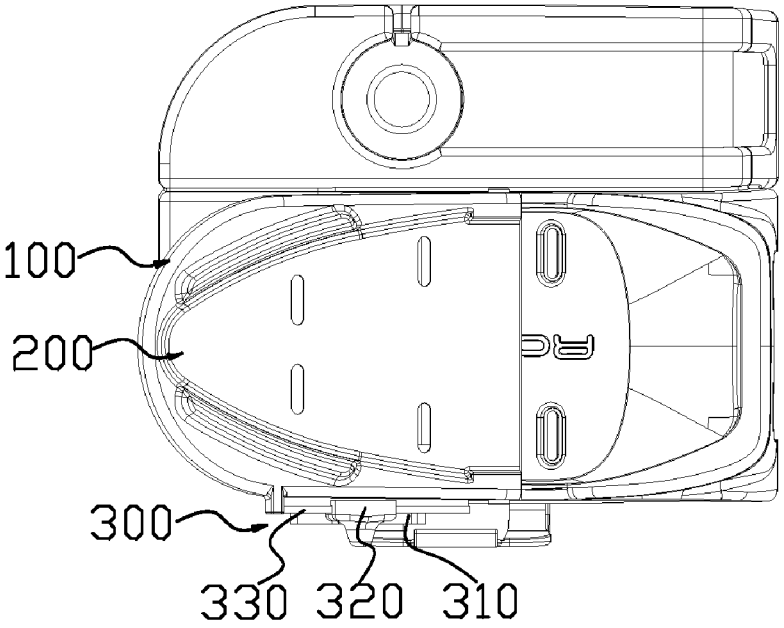
FIG. 1 is a top view of the iron holder in embodiment 1.
Figure 2:
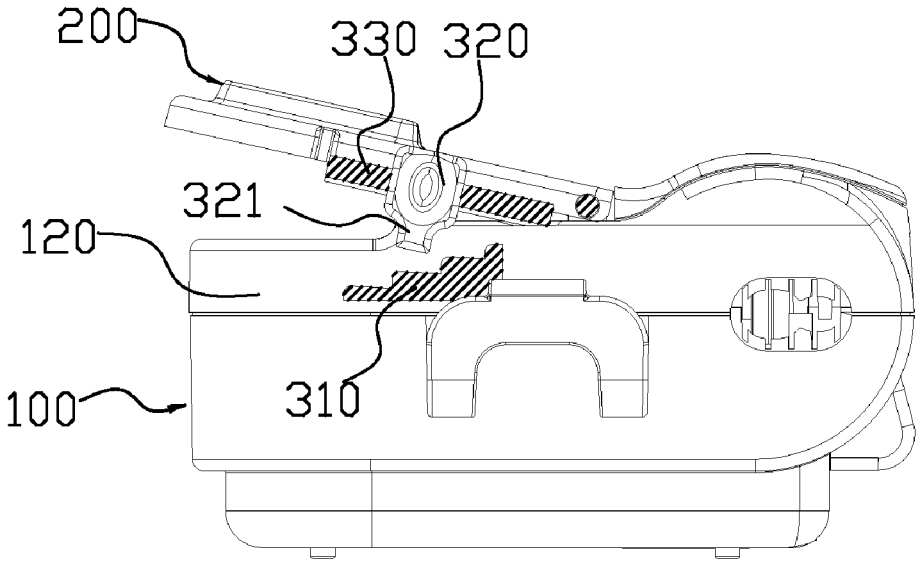
FIG. 2 is a side sectional view of the iron holder in embodiment 1.

Referring to FIG. 1 and FIG. 2, they show the top and sectional views of the iron holder in this embodiment respectively. An iron holder comprises a base 100, an insulation board 200 and an angle adjusting unit 300.

The top of the base 100 has a groove 120, the left side and right side of the lower portion of the insulation board 200 have a pivoted portion extending outwardly respectively, the pivoted portion pivotally connected to the base 100 to form a pivoted connection relationship between the insulation board 200 and the base 100. And the insulation board 200 will be positioned in the groove 120 when the insulation board 200 is in the lowest position.

The angle adjusting unit 300 comprises a step seat 310, a sliding device 320 and a sliding track 330. The sliding track 330 is fixed in the left side of the insulation board 200. The lower portion of the sliding device 320 has an abut portion 321 extending downwardly below the insulation board 200, and the sliding device 320 is slidingly connected on the sliding track 330 to form a sliding connection relationship between them, when appropriate, a lock unit for locking or releasing the sliding device 320 relative to the sliding track 330 can be arranged between the sliding device 320 and the sliding track 330. The step stool 310 is fixed on the base 100, and the step stool 310 forms four steps facing upward.

A user can slide the sliding device 320 relative to the slide track 330, then put the abut portion 321 of the sliding device 320 against at least a step of the step stool 310. The higher step the abut portion 321 is abut against, the bigger the angle between the insulation board 200 and base 100 is formed.

Embodiment 2

Figure 3:
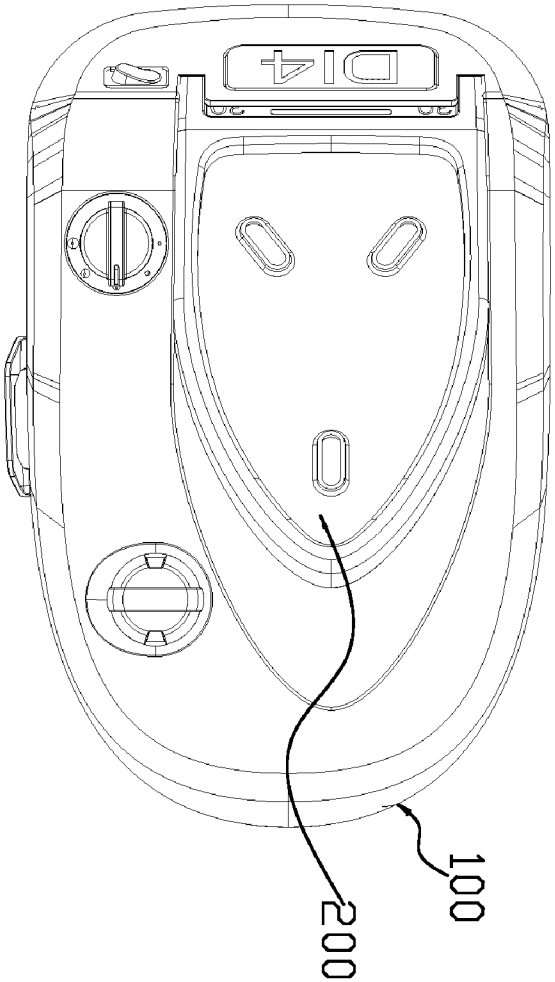
FIG. 3 is a top view of the iron holder in embodiment 2.
Figure 4:
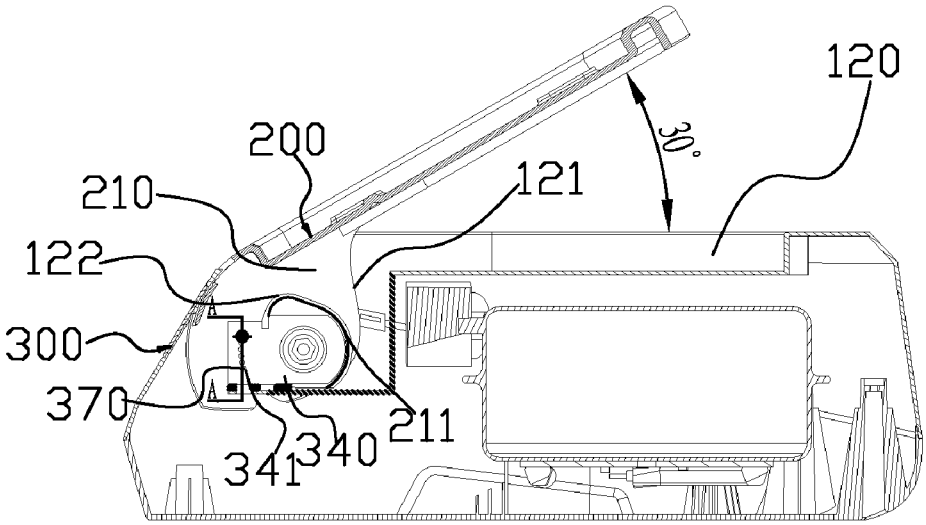
FIG. 4 is a side sectional view of the iron holder in embodiment 2.
Figure 5:
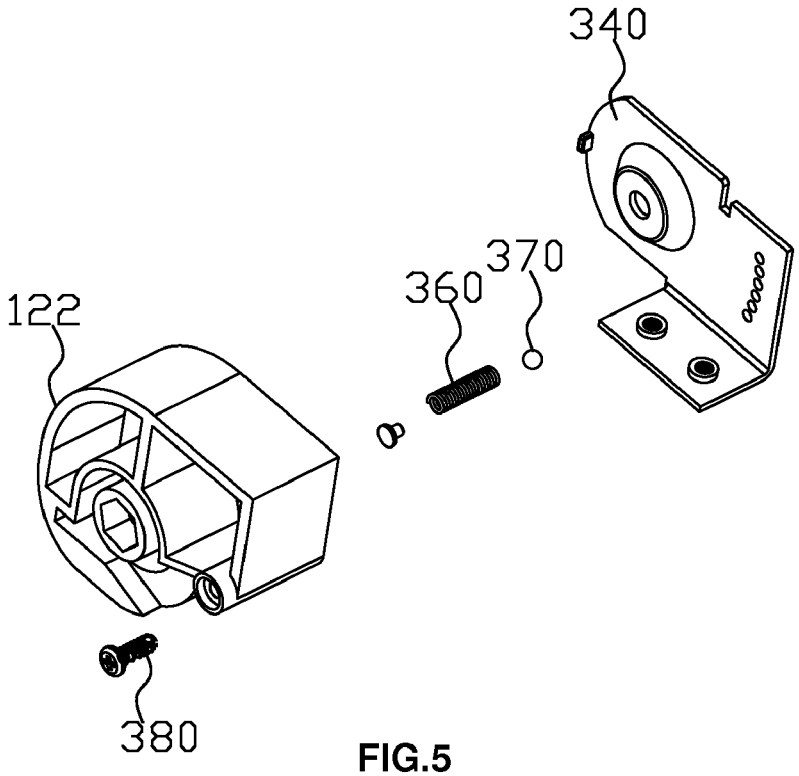
FIG. 5 is a partial enlarged view of the iron holder in embodiment 2.
Figure 6:
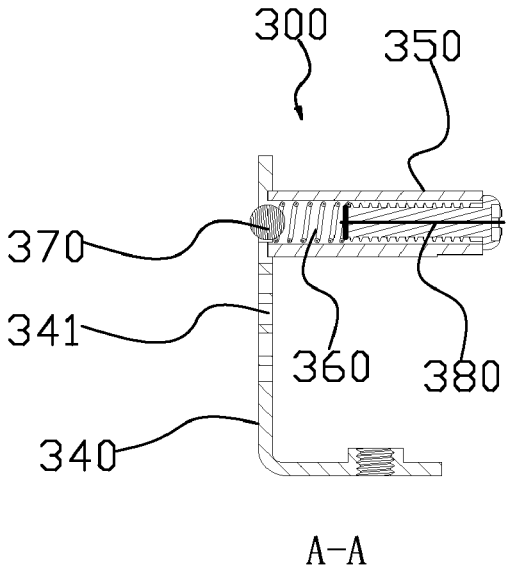
FIG. 6 is a sectional view of A-A of FIG. 4.

Referring to FIG. 3 to FIG. 5, they show the top and sectional views of the iron holder in this embodiment. An iron holder comprises a base 100, an insulation board 200 and an angle adjusting unit 300.

The top of the base 100 has a groove 120, the groove 120 has two inserting slots 121 in the front portion, and the base 100 has two couplers 122. The lower portion of the insulation board 200 has two lugs 210, each lug 210 has a revolving seat 211. The two lugs 210 of the insulation board 200 are inserted into the two slots 121 respectively, thus the revolving seat of the insulation board 200 is pivotally connected to the coupler of the base 100 to form a revolving connection relationship between the insulation 200 and the base 100. The insulation board 200 will be positioned in the groove 120 when the insulation board 200 is in the lowest position.

The angle adjusting unit 300 comprises an adjusting board 340, a position sleeve 350, an elastomer 360, a ball 370 and an adjusting screw 380. The adjusting board 340 fixed on the base 100, and there are six lock holes 341 on the adjusting board 340, these lock holes 340 arranged in an arc whose center is located on the pivotal shaft between the insulation board 200 and the base 100, herein the diameter of each lock hole 341 is smaller than the diameter of the ball 370. The position sleeve 350 is fixed on the lug of the insulation board 200; the adjusting screw 380 extends through the lug from outer into inner side; the elastomer 360 mounted in the position sleeve 350, and its outer side connects with the inner side of the screw 380, its inner side connects with the ball 370 to let the inner side of the ball 370 be positioned in one of the lock holes 341.

In use, the user can revolve the insulation board 200 relative to the base 100, thus the adjusting board 340 presses the elastomer 360 and drives the sleeve 350 revolved, after reaching a desired angle, aligning the ball 370 to one of the hole 341, then the ball 370 will be inserted into the lock holes 341 by the action of the elastomer 360 to lock the angle between the insulation board 200 and the base 100. The higher the position of the lock hole 341, the bigger the angle formed between the insulation board 200 and the base 100. In this embodiment, the angle θ between the insulation board 200 and the base 100 may be from 0 degree to 90 degrees.

The users can adjust the screw 380 to adjust the elasticity of the elastomer 360 to adjust the needed force of revolving the insulation board 200.

Embodiment 3

An iron holder comprises a base 100, an insulation board 200 and an angle adjusting unit 300. the lower portion of the insulation board 200 has two lugs 210, the base 100 has a coupler 110.

Figure 7:
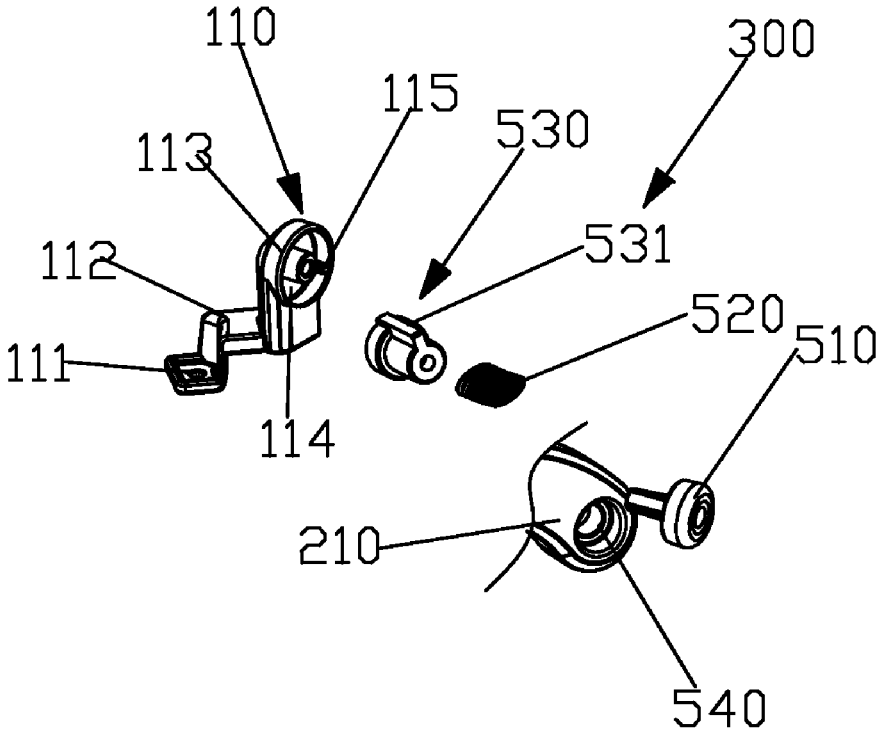
FIG. 7 is an exploded view of the coupler of the iron holder in embodiment 3.

Referring to FIG. 7, the coupler 110 has a fixing portion 111, a folding portion 112 and a connecting portion 113, the fixing portion 111 and the folding portion 112 is incorporated with the connecting portion 113, the fixing portions 111 are fixed on the left surface and right surface of the base 100 respectively, the folding portion 112 is between the fixing portion 111 and the connecting portion 113, the outer side of the connecting 113 inwardly recessed to form an annular holding hole 114, and there is a limit block 115 in the annular holding hole 114.

The two lugs 210 abut against the coupler 110 in the outer side of the base 100 to form revolving relationship, herein at least an angle adjusting unit 300 is arranged between a lug 210 and its corresponding coupler 110. The angle adjusting unit 300 comprises a push button 510, an elastomer 520, a block (or a push block) 530 and a penetration hole 540.

The lug 210 of the insulation board 200 has a step-shaped penetration hole 540 with smaller size inside and larger size outside, the smaller-sized portion of the penetration hole 540 has a transverse inward recess portion.

The push button 510 is step-shaped and is corresponding to the shape of the penetration hole 540. The push button 510 is inserted in the penetration hole 540 from the outer side to the inner side, the smaller-sized shaft of the push button 510 is corresponds to the smaller-sized portion of the penetration hole 540, and the larger-sized shaft of the push button 510 corresponds to the larger-sized portion of the penetration hole 540.

The tail of the block 530 is in annular shape, and there is a transverse protrusion 531 extending upwardly on the block 530. The head of the block 530 connected to the tail of the smaller-sized shaft of the push button 510. The tail of the block 530 can be mounted revolvably in the annular hole 114 of the coupler 110, and the transverse protrusion 531 is cooperated with the block 115 of the annular hole 114 to form a revolvable connection relationship and the utmost revolveing angle is A1.

The elastomer 520 sheathed on the smaller-sized shaft of the push button 510, one end of the elastomer 520 connected to the annular surface of the larger-sized shaft of the push button 510, another end connected to the coupler 110, in the action of the elastomer, the push button 510 is pressed so that its head extends out of the outer surface of the lug 210, the transverse protrusion 531 inserted in the inward recess of the lug 210 to form a synchronized-revolve relationship between the push button 530 and lug 210. Herein one end of the transverse inward recess of the lug 210 connecting to the inner side of the lug 210, another end is closed; the transverse length of the inward recess is equal to the maximum moving distance of the push button 510 so that when the push button 310 be pressed entirely, the head of the block 530 is equal to the corresponding surface of the coupler 110.

Figure 8:
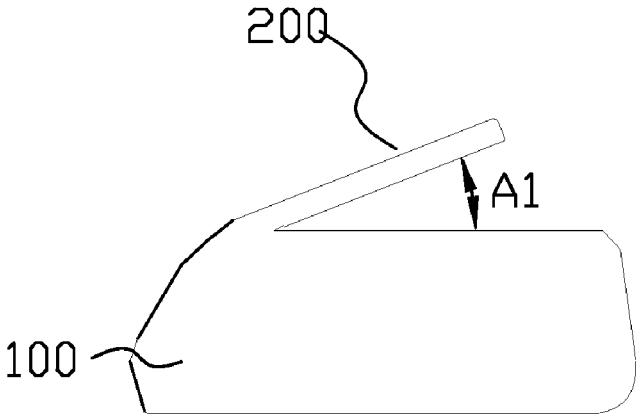
FIG. 8 illustrates the iron holder in A1 angle position in embodiment 3.

When the insulation board 200 is in covering status, the transverse protrusion 531 will insert into the transverse inward recess of the lug 210 by the action of the elastomer 520, thus the slide 530 and the lug 210 formed synchronous revolving relationship, if the users raise the insulation board 200, the lug 210 and the slide 530 will be revolved relative to the coupler 110 and the base 100, when the transverse protrusion 531 of the slide 330 turned into the limit block 115 of the coupler 110, the revolving movement of the slide 530 will be stopped, i.e. this is the utmost revolving angle for A1, referring to FIG. 8, it illustrates the A1 angle between the insulation 200 and the base 100.

Figure 9:
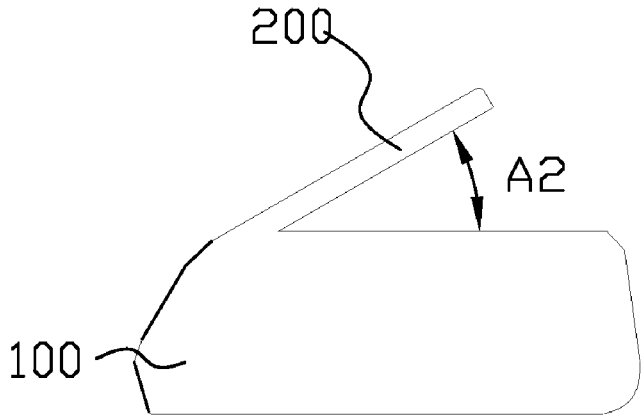
FIG. 9 illustrates the iron holder in A2 angle position in embodiment 3.

When the push button 510 be pushed, the slide 530 will move back until the head surface of the slide 530 is equal to the corresponding surface of the coupler 110, then the transverse protrusion 531 of the slide 530 deviated from the transverse inward recess of the lug 210, thus the slide 530 and the lug 210 formed free revolving relationship, i.e. the lug 210 can revolve relative to the slide 530, coupler 110 and base 100, revolve the insulation board 200 till to the angle A2 (reffering to FIG. 9), A2 is larger than A1.

If the insulation board 200 needed to be closed, the user only needs to revolve the insulation board directly when revolve to the A1 angle By the action of the elastomer 360, the transverse protrusion 531 of the slide 530 will insert into the transverse inward recess of the lug 210, thus the slide 530 formed synchronous revolving relationship with the lug 210 again.

Embodiment 4

The difference of this embodiment to the embodiment 3 is that: the smaller-sized portion of the penetration hole 540 has multiple inward recesses, when the push button 510 be pushed, the slide piece 530 will be moved back until the head surface of the slide piece 530 is equal to the corresponding surface of the coupler 110, then the transverse protrusion 531 of the slide piece 530 deviated from one of the transverse inward recesses of the lug 210, thus the slide piece 530 and the lug 210 formed free revolving relationship, i.e. the lug 210 can revolve relative to the slide piece 530, coupler 110 and base 100, revolve the insulation board 200 till the transverse protrusion 531 of the slide piece 530 inserts into another transverse inward recess of the lug 210 again. By abovementioned method the transverse protrusion 331 of the slide piece 530 can be inserted into anyone transverse inward recess of the lug 210, thus the angle between the base 100 and the insulation board 200 can be adjusted.

Embodiment 5

Figure 10:
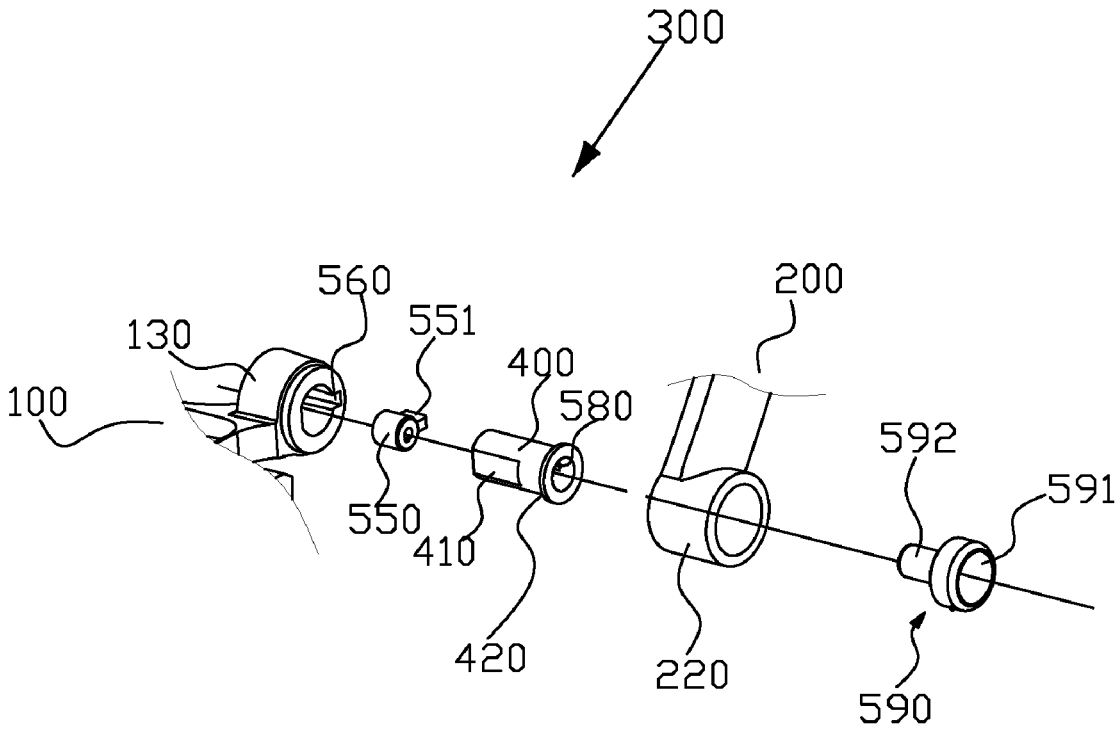
FIG. 10 is an exploded view of the coupler of the iron holder in embodiment 5.
Figure 11:
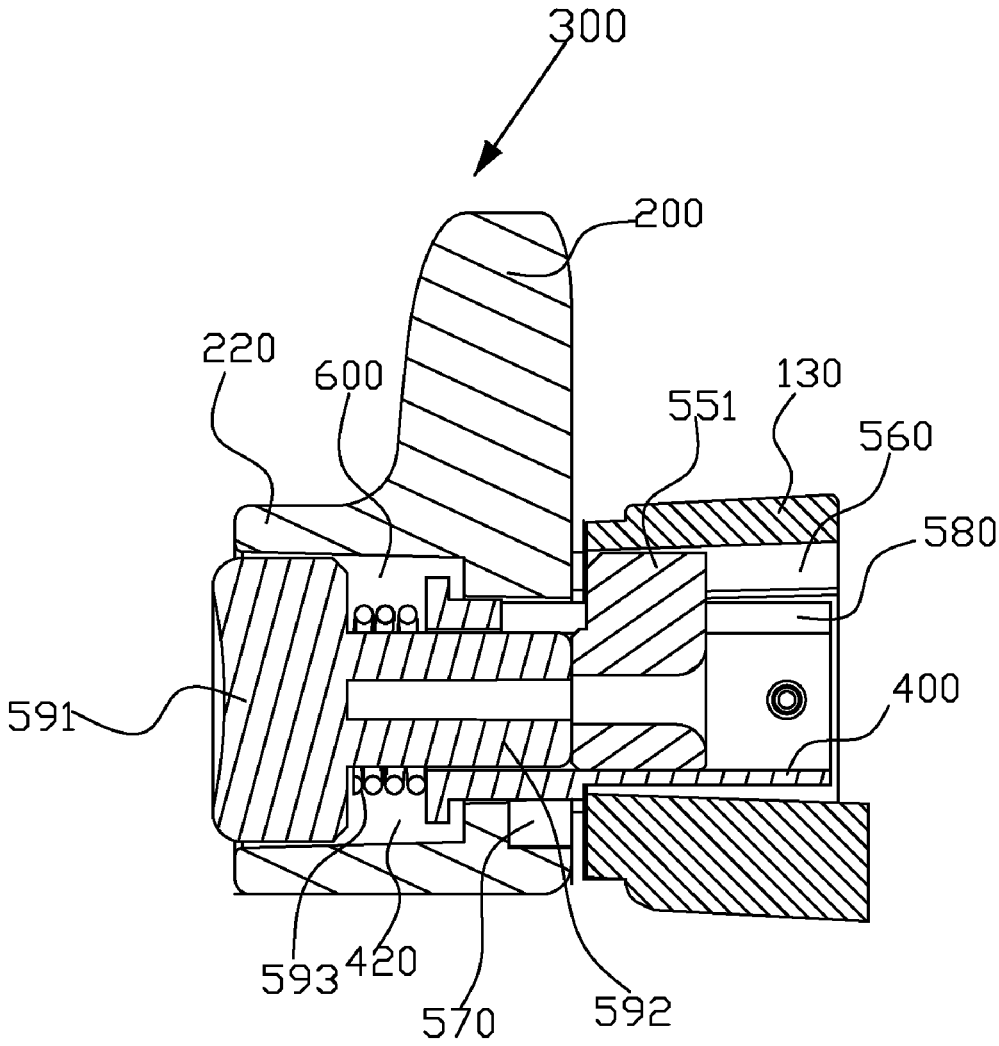
FIG. 11 is a sectional view of FIG. 10.

Referring to FIG. 10 and FIG. 11, it shows the exploded view and sectional view of the coupler of the iron holder in embodiment 5 respectively. An iron holder comprises a base 100, an insulation board 200 and an angle adjusting unit 300. The rear portion of the side of the base 100 pivotally connected with the connecting portion 220 of the insulation board 200 according to an axis of sleeve 400 via a coupler 130 to form revolvable connection. The angle adjusting unit 300 comprises at least a slide piece 550, a position groove 560, an arc groove 570, a position opening 580 and a push button 590.

The slide piece 550 connected to the sleeve 400 along the axis direction, the wall of the slide piece 550 has a position protrusion 551, the position groove 560 corresponding to the position protrusion 551 is arranged in the coupler 130 of the base 100, and is for the position protrusion 551 sliding along the axis direction. There is an arc groove 570 corresponding to the position protrusion 551 in the connection portion 220 of the insulation board 200, it is used for the position protrusion 551 revolve limitedly, the said sleeve 400 has an position opening 580 corresponding to the position groove 560.

When the slide piece 550 sliding along the axis direction in the sleeve 400, the position protrusion 551 will slide along the said position groove 560 and the position opening 580, so that the slide piece 550 can slide relative to the sleeve 400 and connection portion 220, but can not revolve relative to the sleeve 400 and connection portion 220, and the sleeve 400 can not revolve relative to connection portion 220. And the sleeve 400 can be positioned relative to the connection portion 220 by being locked from the lower portion of the connection portion 210 with a screw and by the cut surface 410 of the sleeve 400, thus the sleeve 400 can not revolve or slide relative to connection portion 220. When the slide piece 550 is between the connection portion 110 and the connection portion 220, the position protrusion 551 will partially insert into the arc groove 570, thus the revolving of the insulation board 200 relative to the sleeve 400 will be limited to the arc groove 570, in this embodiment, the angle of the arc groove 570 is A1. When the slide piece 550 slides into the connection portion 110 totally, the position protrusion 551 is inserted into the position groove 570 totally and will not limit the insulation board 200, so in this status, the insulation board 200 will revolve freely relative to the sleeve 400 to the utmost position A2.

The push button 590 arranged in the connection portion 220 of the insulation board 200, the push button 590 can push the slide piece 550 from the position between the coupler 130 of the insulation board 200 and the connection portion 220 of the base 100 into the coupler 130 of the base 100. The sleeve 400 inserts into the coupler 130 of the base 100 from the outside opposite to the base 100 of the connection portion 220 of the insulation board 200, and the sleeve 400 has a flange 420 to prevent from exceeding insertion. The push button 590 includes a head 591 and a smaller-sized shaft 592, the shaft 592 inserts into the sleeve 400, and there is a restoration spring 593 arranged between the head 591 and the outer side of the sleeve 400, the slide piece 550 fixed into the inner side of the shaft 592 via a screw. When the push button 590 is pressed, the slide piece 550 will totally insert into the connection portion 110 of the base 100; when the push button 590 be released, the slide piece 550 will be repositioned in the position between the coupler 130 of the base 100 and the connection portion 220 of the insulation board 200 by the action of the restoration spring 593, i.e. it can achieve the switch of the two status by the push button 590. In addition, a groove 600 formed in the outside opposite to the base 100 of the connection portion 220 of the insulation board 200, the flange 420 of the sleeve 400, the head 591 of the push button 590 and the spring 593 between them are all in the groove 600 and protected by the groove 600.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. An iron holder comprising a base and an insulation board for supporting the iron, the base forming a revolvable relationship with the insulation board, wherein an angle adjusting unit is arranged between the insulation board and the base for adjusting the revolving angle of the insulation board revolving relative to the base, wherein the insulation board is pivotally connected with the base, the angle adjusting unit comprising:

a sliding device which is slidingly connected with the insulation board to form a sliding-connection relationship between the sliding device and the insulation board; and a step stool fixed on the base, wherein the step stool has at least a step, and wherein the sliding device abuts against a step of the step stool, and wherein the insulation board has a flange which comprises a sliding track, and the sliding device is slidingly connected with the sliding track.

2. The iron holder according to claim 1, wherein a lock unit arranged between the sliding track and the sliding device for locking or releasing the sliding device relative to the sliding track.

3. An iron holder comprising a base and an insulation board for supporting the iron, the base forming a revolvable relationship with the insulation board, wherein an angle adjusting unit is arranged between the insulation board and the base for adjusting the revolving angle of the insulation board revolving relative to the base, wherein the insulation board comprises two lugs arranged on the lower portion of the insulation board, each lug having a revolving seat; wherein the base has comprises couplers, and wherein each of the revolving seat is pivotally connected with the coupler respectively;

wherein the angle adjusting unit comprises:

an adjusting board fixed on the base, the adjusting board having at least a lock hole, each lock hole arranged in an arc whose center is on the shaft between the insulation board and the base, and a compress portion comprising a sleeve fixed on the lug, an elastomer in the sleeve and a ball abutting against the inner end of the elastomer, the inner terminal of the ball positioned in one of the lock holes, and the diameter of the ball is larger than the diameter of the lock hole.

4. The iron holder according to claim 3, wherein the compress portion further comprises an adjusting screw which threads through the lug from outside into inner side, and the inner end of the screw connects with the out end of the elastomer.

5. The iron holder according to claim 3, wherein the adjusting board has six lock holes.

6. An iron holder comprising a base and an insulation board for supporting the iron, the base forming a revolvable relationship with the insulation board, wherein an angle adjusting unit is arranged between the insulation board and the base for adjusting the revolving angle of the insulation board revolving relative to the base, wherein the adjusting unit comprises:

at least a connecting penetration hole having at least a transverse recess portion in the inner side;

a push button, its end being through the penetration hole from the outside into inner side;

an elastomer connecting with the inner side of and sheathing the push button; and a pushing block with a transverse protrusion, wherein the head of the pushing block connects to the end of the push button; the transverse protrusion of the pushing block is inserted in the transverse recess portion of the penetration hole by the action of the elastomer; wherein when the push button is pressed, the pushing block is pushed back transversely, and the transverse protrusion of the push button disengages from the transverse recess portion of the penetration portion.

7. An iron holder comprising a base and an insulation board for supporting the iron, the base forming a revolvable relationship with the insulation board, wherein an angle adjusting unit is arranged between the insulation board and the base for adjusting the revolving angle of the insulation board revolving relative to the base, wherein the base is pivotally connected with the insulation board via a sleeve axis, and wherein the angle adjusting unit comprises at least:

a slider connecting slidingly with the sleeve on the shaft direction, and the side of the slider comprising a position protrusion;

a slot arranged in the base corresponding to the position protrusion, wherein the position protrusion can slide along the axis direction of the slot;

an arc limit groove arranged on the insulation board corresponding to the position protrusion whereby the position protrusion can rotate limitedly in the groove;

a position opening in the sleeve corresponding to the slot; and a button on the insulation board for pushing the slider from the position between the insulation board and the base to the pivotal connection portion of the base.

* * * * *